United States Patent [19]

Takahashi

[11] Patent Number: 4,661,973

[45] Date of Patent: Apr. 28, 1987

[54] MINIMIZATION OF DISTORTION DUE TO A VOICE COIL DISPLACEMENT IN A SPEAKER UNIT

[75] Inventor: Shunichi Takahashi, Saitama, Japan

[73] Assignee: Pioneer Electronic Corporation, Tokyo, Japan

[21] Appl. No.: 677,405

[22] Filed: Dec. 3, 1984

[30] Foreign Application Priority Data

Dec. 3, 1983 [JP] Japan ..... 58-228669
Feb. 13, 1984 [JP] Japan ..... 59-24889

[51] Int. Cl.[4] ..... H04R 9/06; H04R 9/02; H01F 3/00

[52] U.S. Cl. ..... 379/194; 379/199

[58] Field of Search ..... 179/115.5 R, 115.5 PC, 179/115.5 SF, 117, 119 R, 180; 335/231

[56] References Cited

U.S. PATENT DOCUMENTS 2,180,482 11/1939 Price ..... 179/115.5 SF
3,134,057 5/1964 Tsunoo et al. ..... 179/115.5 R
3,250,862 5/1966 Rollins ..... 179/119 R
3,651,283 3/1972 Doschek ..... 179/115.5 R
4,295,011 10/1981 Hathaway ..... 179/119 R
4,297,537 10/1981 Babb ..... 179/180
4,386,332 5/1983 Saito ..... 335/231
4,508,941 4/1985 Wiggins ..... 179/115.5 PC

FOREIGN PATENT DOCUMENTS 695266 9/1965 Italy ..... 179/119 R
55-3207 1/1980 Japan ..... 179/119 R

*Primary Examiner*—Gene Z. Rubinson
*Assistant Examiner*—Danita R. Byrd
*Attorney, Agent, or Firm*—Sughrue, Mion, Zinn, Macpeak & Seas

[57] ABSTRACT

A speaker of a type having a voice coil wound to a greater length than the length of a magnetic gap into which it extends formed between a pole of a yoke and an annular plate. A magnetic flux density setting structure is provided for establishing a constant value of Bl, where B represents the density of the magnetic flux capable of linking the voice coil and l represents the effective length of the voice coil. The magnetic flux density setting structure may be formed as a tapered surface or surfaces on the pole of the yoke or by a separate tapered plate or plates attached to the annular plate. Further, a metal cap is mounted on the pole covering an upwardly facing cup-shaped body of magnetic material.

16 Claims, 41 Drawing Figures

MINIMIZATION OF DISTORTION DUE TO A VOICE COIL DISPLACEMENT IN A SPEAKER UNIT

BACKGROUND OF THE INVENTION

The present invention relates to a speaker unit, and more particularly, to a speaker unit having a voice coil wound to a length greater than the length of the magnetic gap in which the coil is disposed.

A conventional speaker of the type contemplated by the present invention is illustrated in FIG. 1. The unit shown in FIG. 1 has a pole yoke 1 with a inverted-T cross section and which has around its bottom an annular magnet 2 that is magnetized in the direction of its thickness. A plate 3 rests on the magnet 2 to form a magnetic gap with the peripheral wall of the center pole 1A of the pole yoke 1. A voice coil 5 wound around a bobbin 4 is inserted into the magnetic gap. The bobbin 4 is supported on a frame 7 by a damper 6 that permits vibratory movement of the bobbin. A diaphragm 8 with a center cap 9 is connected to the bobbin 4. The outer periphery of the diaphragm 8 is supported by an edge portion 11 that is fixed to the frame 7 by a gasket 10. In order to make effective use of the magnetic flux in the gap, the voice coil 5 is wound around the bobbin 4 to a length (in the longitudinal direction of the coil) greater than the magnetic gap length. The center pole 1A of the pole yoke 1 is fitted with a metal cap 21 provided to reduce the distortion that is introduced into the coil current by the inductance of the voice coil 5.

The operation of the speaker unit in FIG. 1 is as follows. When a current flows through the voice coil 5, either an upward or downward driving force acts on the coil 5 depending upon the direction of the current flow. Since the coil 5 is mobile, the driving force acting on the coil 5 is transmitted to the diaphragm 8 through the bobbin 4. As a result, the diaphragm 8 pushes the air in front of it, creating sound waves.

The driving force F acting on the coil 5 is expressed as:

$$F = Bli,$$

where B is the density of magnetic flux linking the coil 5, l is the effective length of the coil 5, and i is the current through the coil 5.

FIG. 2A shows the coil 5 positioned so that its center in the widthwise direction coincides with the center of the magnetic gap, and FIG. 2B shows the corresponding profile of magnetic flux density linking the coil 5. FIG. 3A shows the coil 5 positioned in such a manner that its center in the widthwise direction is off the center of the magnetic gap, and FIG. 3B shows the corresponding profile of magnetic flux density linking the coil 5. The area of the hatched portion in each of FIGS. 2B and 3B represents the driving force F acting on the coil 5. As can readily be seen, the hatched area in FIG. 3B is smaller than that in FIG. 2B. In other words, the value of the force factor Bl as a function of the displacement of the coil 5 is not constant within the limits of the oscillatory movement of the coil, but rather, as shown in FIG. 4, the value of Bl, and hence the driving force F, decreases as the center of the coil 5 in the lengthwise direction moves away from the center of the magnetic gap.

Since the force factor Bl as a function of the displacement of the coil 5 is not constant within the limits of the oscillatory movement of the coil, the conventional speaker unit does hot produce a sinusoidal driving force F, even if the input is a sine wave. Instead, a complex wave containing second and third harmonics is produced, and the resulting third-harmonic distortion is one of the major sources of distortion in the sound radiated from the speaker in the range of low sound level.

SUMMARY OF THE INVENTION

The present invention has been accomplished to eliminate these defects of the conventional speaker unit, and the primary object of the invention is to provide a speaker unit that produces sound with minimum distortion and which can be easily constructed.

The speaker unit according to the present invention has a cup-shaped magnetic material whose bottom is placed in contact with a pole surface and which has a flared portion that increases in diameter away from the pole surface. The speaker unit also has a metal cap that is fitted around the pole so as to cover the sup-shaped magnetic material. This metal cap has a tapered portion that decreases in diameter away from the pole surface and a bottom continuous from the tapered portion. The outer periphery of the open end of the cup-shaped magnetic material is placed in contact with the border between the tapered portion and the bottom of the metal cap.

The speaker unit according to the present invention uses a voice coil wound to a length greater than the magnetic gap length and is designed to provide a constant value of Bl, at least within the limits of the oscillatory movement of the voice coil, where B represents the density of the magnetic flux capable of linking the voice coil and l refers to the effective length of the voice coil.

DESCRIPTION OF THE PREFERRED EMBODIMENTS

Figure 1:
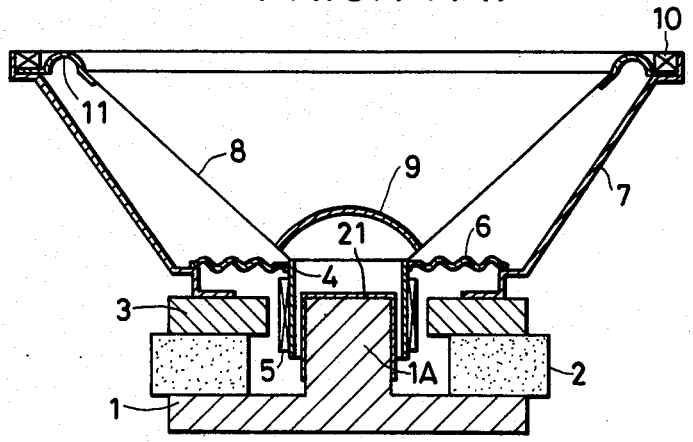
FIG. 1 PRIOR ART
FIG. 1 is a cross section of a conventional speaker unit.
Figure 2A:
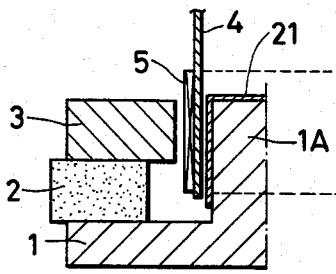
FIG. 2A PRIOR ART
FIGS. 2A and 3A are partial cross sections showing a voice coil at two different positions with respect to the magnetic flux density and FIGS. 2B and 3B show corresponding profiles of the magnetic flux density.
Figure 2B:
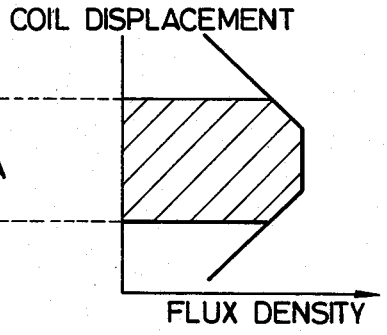
FIG. 2B PRIOR ART
Figure 3A:
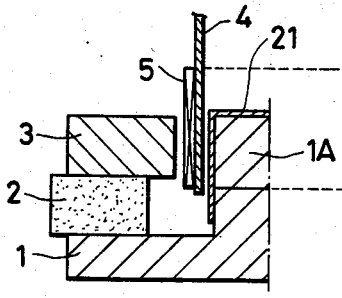
FIG. 3A PRIOR ART
Figure 3B:
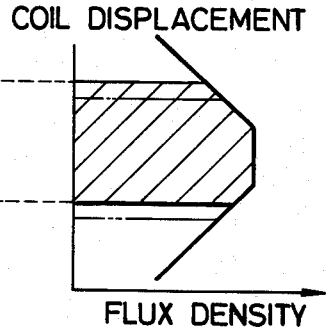
FIG. 3B PRIOR ART
Figure 4:
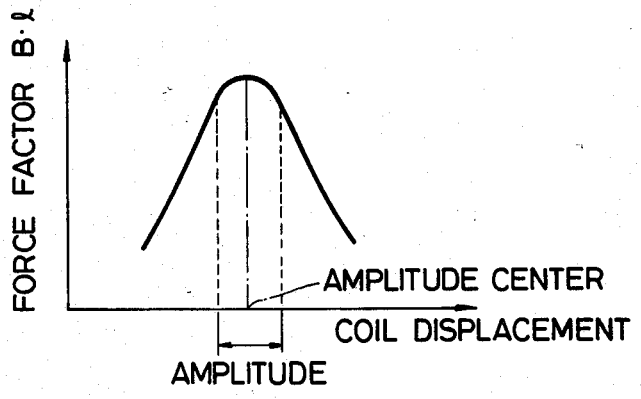
FIG. 4 PRIOR ART
FIG. 4 shows the relationship between the displacement of the voice coil in the conventional speaker unit and the force factor acting on the coil.
Figure 5:
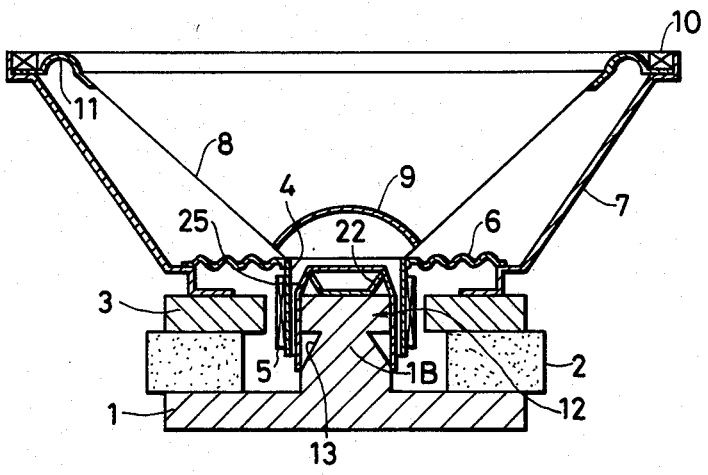
FIG. 5 is a cross section showing a speaker unit according to a first embodiment of the present invention.
Figure 6:
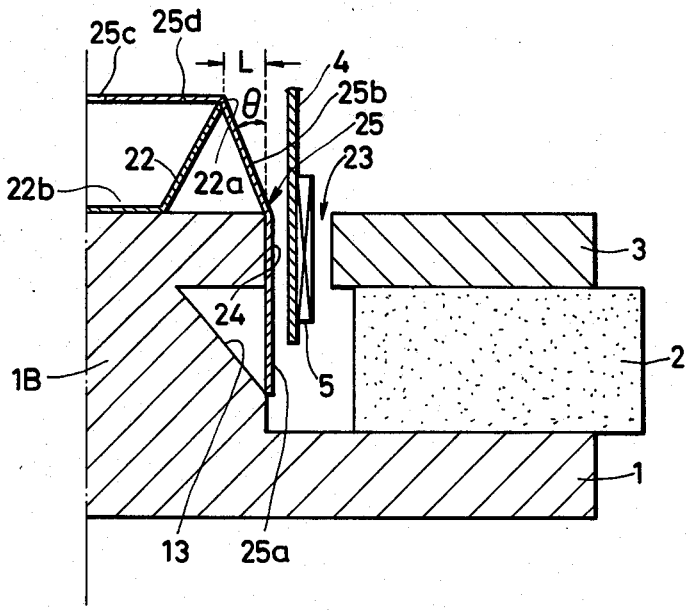
FIG. 6 is an enlarged view showing an essential part of FIG. 5.

Several preferred embodiments of the present invention are hereunder described with reference to FIGS. 5 to 24. FIG. 5 shows in cross section a speaker unit according to a first preferred embodiment of the invention, and FIG. 6 is an enlarged view of an essential part of FIG. 5. In FIGS. 5 and 6, the components which are the same as those shown in FIG. 1 are identified by like reference numerals.

As shown in FIGS. 5 and 6, the speaker unit according to the first preferred embodiment of the present invention has a center pole 1B which is provided with a flared surface below the portion 12 which faces the plate 3. The flared surface increases in diameter in the direction away from the portion 12. On top of the center pole 1B rests a cup-shaped magnetic material 22 having a bottom which is in contact with the center pole 1B and a flared portion which increases in diameter away from the top of the center pole 1B. The flared surface 13 on the center pole 1B combines with the cup-shaped magnetic material 22 to provide a magnetic flux density that provides a constant value of the force factor Bl, at least within the limits of the oscillatory movement of the coil 5.

Figure 7:
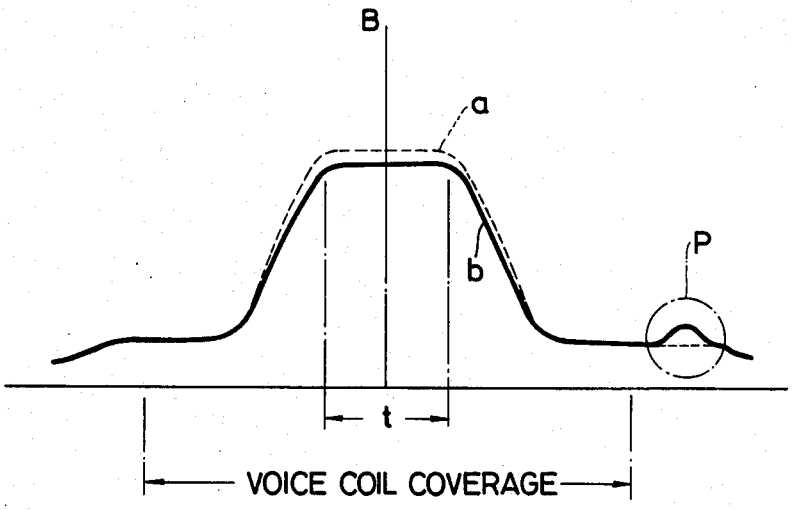
FIG. 7 shows a magnetic flux density profile in the magnetic gap of the speaker unit of FIG. 5.

In order to prevent the outer periphery 22*a* of the open end of the cup-shaped magnetic material 22 from causing adverse effects on the desired distribution of the magnetic flux density in the magnetic gap 23, it is essential that the outer periphery 22*a* be separated by a given distance L from an extension of the surface 24 of the center pole 1B where it forms the magnetic gap with the plate 3. FIG. 7 shows two flux distribution curves for the magnetic gap 23; curve a, indicated by a dashed line, represents the flux distribution obtained when the distance L is provided between the outer periphery 22*a* of the cup-shaped magnetic material 22 and the surface 24 of the center pole 1B, and curve b, indicated by a solid line, represents the flux distribution obtained when no distance L is provided and the outer periphery 22*a* extends to the position of the surface 24. In the latter case, the presence of the outer periphery 22*a* of the magnetic material 22 results in a less magnetoresistant area in the gap 23, and the resulting increase in magnetic flux passing through this area produces a distortion P in the flux distribution, thereby causing a distortion in the current through the voice coil. In order to avoid this disadvantage, it is necessary that distance L be provided between the outer periphery 22*a* of the cup-shaped magnetic material 22 and the surface 24 of the center pole 1B. In FIG. 7, t represents the width (or thickness) of the plate 3.

Figure 8A:
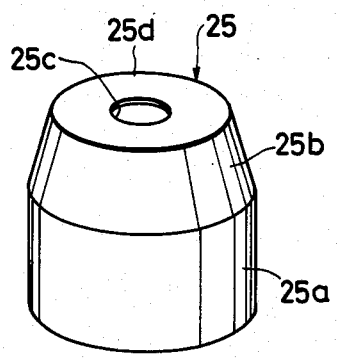
FIG. 8A is a perspective view of the metal cap shown in FIG. 5.
Figure 8B:
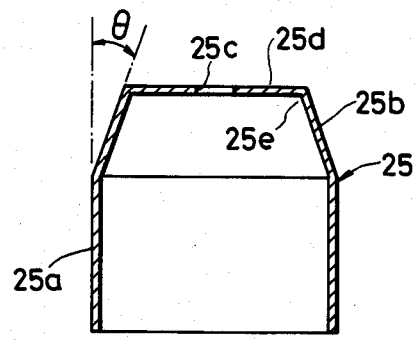
FIG. 8B is the corresponding cross section.
Figure 9A:
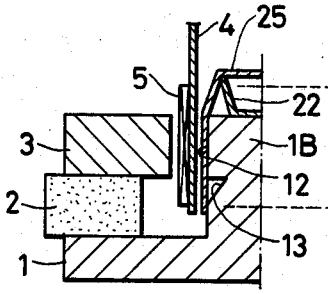
FIGS. 9A and 10A are partial cross sections showing a voice coil at two different positions with respect to the magnetic gap.
Figure 9B:
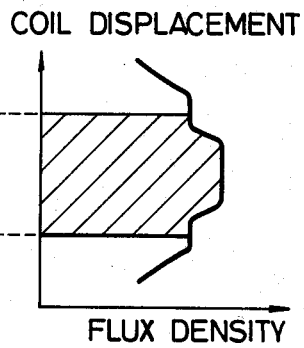
FIGS. 9B and 10B show corresponding profiles of the magnetic flux density.
Figure 10A:
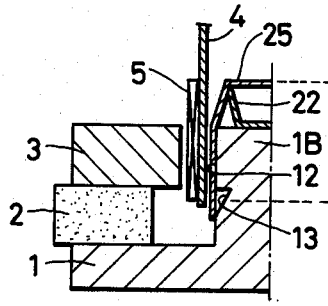
Figure 10B:
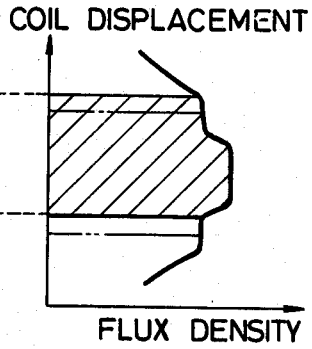

The center pole 1B is fitted with a metal cap 25 that covers the cup-shaped magnetic material 22. The cap 25 is made of a conductive material such as copper, and, as shown in FIGS. 8A and 8B, the cap is composed of a cylindrical portion 25*a*, a tapered portion 25*b* continuous with the cylindrical portion, and a flat bottom portion 25*d* that is continuous with the tapered portion and which has a hole 25*c* in the center. The taper of the portion 25*b* is linear and forms an angle $\theta$ with the side wall of the cylindrical portion 25*a*. This means the tapered portion 25*b* decreases in diameter away from the pole surface or the top of the center pole 1B.

Figure 11:
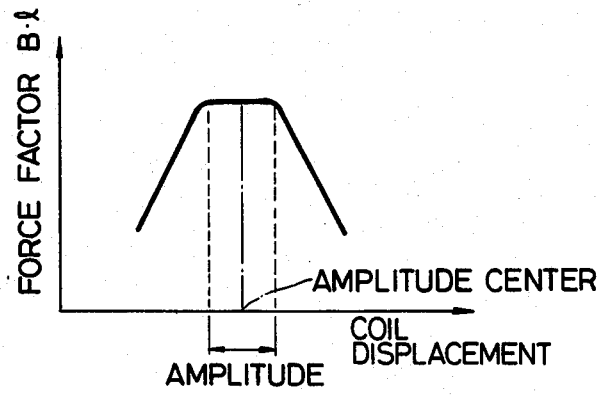
FIG. 11 shows the coil displacement vs. force factor for the speaker unit of the present invention.

As in the usual case, the magnitude of the magnetic flux density in the gap between the center pole 1B and the plate 3 depends on the length of the magnetic path. Therefore, by forming the flared surface 13 below the portion 12 of the center pole 1B where it faces the plate 3 and by providing the cup-shaped magnetic material 22 on top of the center pole, a step profile of the magnetic flux density of the type shown in FIG. 9B can be provided at the portion 12 and tapered surface 13 of the center pole 1B, as well as the cup-shaped magnetic material 22. Even if the voice coil 5 is displaced from the position shown in FIG. 9A to that shown in FIG. 10A, no change occurs in the total magnetic flux linking the coil 5, and, as shown in FIG. 11, the value of the force factor Bl remains constant within the limits of oscillatory movement of the coil. As a consequence, as can readily be understood by comparing the shaded areas in FIG. 9B and FIG. 10B, the driving force F (corresponding to the size of the shaded area) acting on the coil 5 also remains the same within the limits of the oscillatory movement of the coil. This means a sinusoidal driving force F is produced in response to a sine-wave current flowing through the coil 5.

Figure 12:
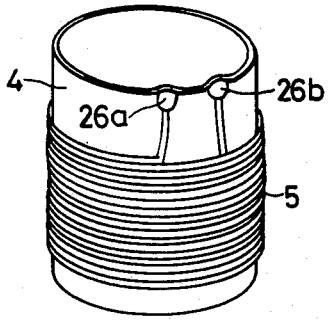
FIG. 12 is a perspective view showing the bobbin and voice coil in the speaker unit of FIG. 5.

If, as shown in FIG. 12, leads 26*a* and 26*b* from the voice coil 5 are soldered to the bobbin 4, depressions unavoidably are formed at the soldered portions. However, because of the taper, the inward projections or the bottom of the metal cap 25 will not contact the depressions, permitting smooth vibration of the mobile components of the speaker unit.

In constructing the speaker unit of the first embodiment shown above, the cup-shaped magnetic material 22 is placed on the center pole 1B so that the bottom 22B is in contact with the top of pole, and subsequently the metal cap 25 is fitted around the center pole 1B so that the cup-shaped magnetic material 22 is covered with the cylindrical portion 25*a*. The dimensions of the metal cap are determined so that, when it is slipped over the center pole, the outer periphery 22*a* of the open end of the cup-shaped material 22 comes into contact with the border 25*e* (not shown in FIG. 6) between the tapered portion 25*b* and bottom 25*d* of the cap. Therefore, by slipping the metal cap 25 over the pole 1B, the cup-shaped magnetic material 22 is put in the correct position at the same time.

In the embodiment shown above, the cup-shaped magnetic material is flared and the metal cap tapered linearly; however, the flare or taper may be curved rather than linear. Being tapered, the metal cap can be drawn from a blank more easily than a cap of a simple cylindrical shape, and even an elongated cap can be readily produced.

The foregoing embodiment relates to a case where the flared surface 13 of the center pole 1B combined with the cup-shaped magnetic material 22 to provide a magnetic flux density that maintains the value of force factor Bl constant, at least within the limits of the oscillatory movement of voice coil 5. Various modifications may be made to this arrangement, as will be described below.

Figure 13A:
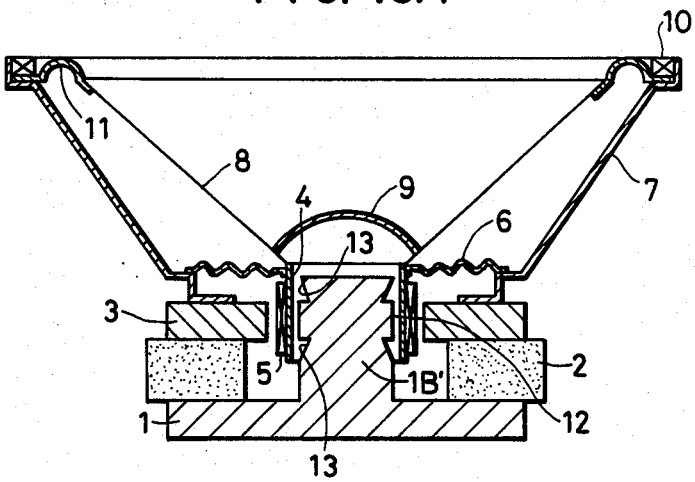
FIG. 13A is a cross section showing a modification of the magnetic flux density setting arrangement shown in FIG. 5.
Figure 13B:
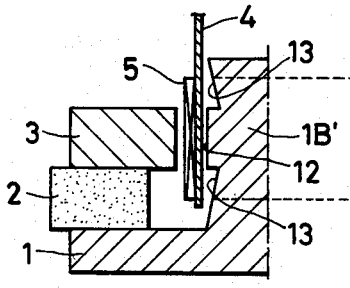
FIG. 13B and FIG. 13D are partial cross sections showing a voice coil at two different positions with respect to the magnetic gap in the speaker unit of FIG. 13A, and FIG. 13C and FIG. 13E show the corresponding profiles of magnetic flux density.
Figure 13C:
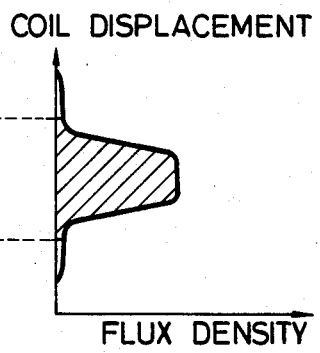
FIG. 13F shows the coil displacement vs. force factor for the speaker unit of FIG. 13A.
Figure 13D:
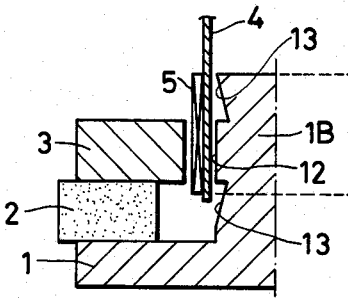
Figure 13E:
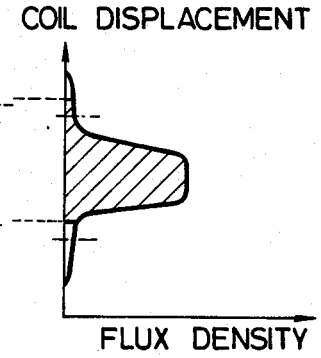
Figure 13F:
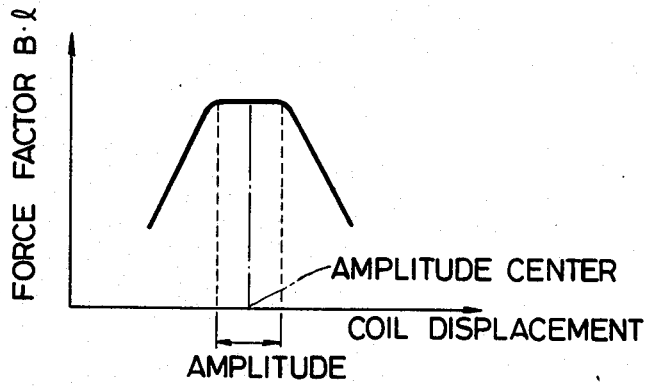

A modification of the above-described magnetic flux density setting arrangement is illustrated in cross section in FIGS. 13A, 13B and 13D, wherein components which are the same as those shown in FIG. 5 are identified by like reference numerals. The pole yoke 1 has a center pole 1B' whose top is higher than the upper limit of the vertical vibratory displacement of the top edge of the voice coil 5. The center pole 1B' has a flared surface 13, both above and below the portion 12 which faces the plate 3, and this flared surface 13 increases in diameter away from the portion 12. The configuration of the speaker unit shown in FIGS. 13A, 13B and 13D is the same as that shown in FIG. 5 except that the cup-shaped magnetic material 22 is replaced by the upper flared surface 13. The two flared surfaces 13 formed on the periphery of the center pole 1B' combine to form a magnetic flux density setting arrangement which achieves substantially the same advantages as obtained in the embodiment of FIG. 5. A step profile as shown in FIGS. 13C and 13D is provided at the portion 12 and tapered surfaces 13 of the pole 1B'. FIG. 13F shows the coil displacement vs. force factor for the speaker unit of FIG. 13A.

Figure 14:
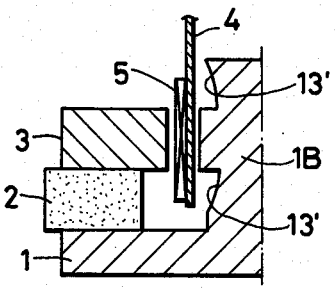
FIGS. 14 and 15 are partially enlarged views showing variations of the embodiment of FIG. 13.
Figure 15:
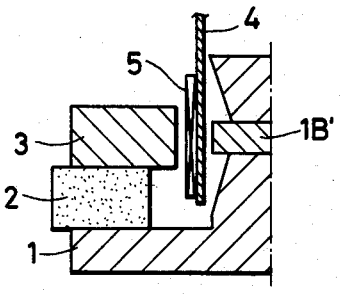

The flare of the surfaces 13 need not be linear, and, as shown in FIG. 14, curved flares 13' may be used. The curvature of each flare 13' may be properly selected so as to provide a uniform magnetic flux in the neighborhood of both ends of the voice coil 5. The thickness of the portion 12 of the center pole 13' which faces the plate 3 need not be the same as the thickness of the plate 3. Furthermore, the center pole 1B' need not be integral with the pole yoke 1, and instead, it may be an assembly of two or more parts, as shown in FIG. 15.

Figure 16:
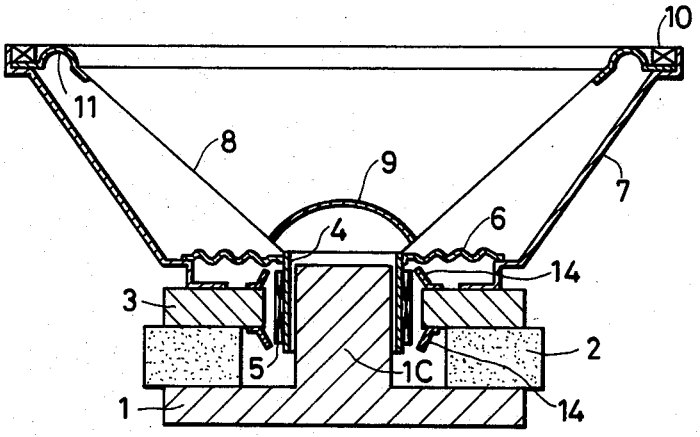
FIG. 16 is a cross section showing another modification of the magnetic flux density setting arrangement.
Figure 17A:
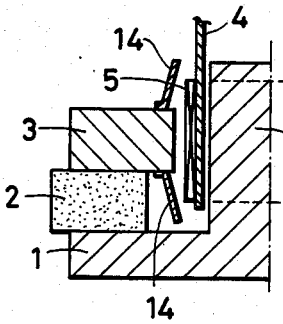
FIG. 17A is a partial cross section showing a voice coil at a certain position with respect to the magnetic gap.
Figure 17B:
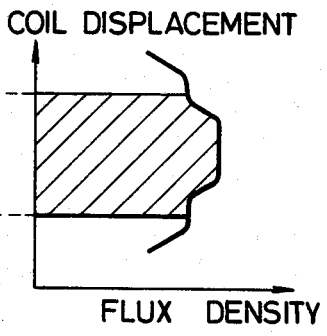
FIG. 17B shows the corresponding profile of magnetic flux density.

FIG. 16 shows in cross section another modification of the magnetic flux density setting arrangement, and in FIG. 16, components which are the same as those shown in FIG. 1 are identified by like reference numerals. The pole yoke 1 has a center pole 1C whose top, as in FIG. 13, is higher than the upper limit of the vertical oscillation of the top edge of the voice coil 5. The top and bottom of the plate 3 are provided with a tapered magnetic plate 14 which is inclined toward the center pole 1C and decreases in inside diameter away from the plate 3. The two magnetic plates combine to form a magnetic flux density pattern which maintains the value of force factor Bl constant, at least within the limits of the oscillatory movement of the voice coil 5. According to the arrangement shown in FIG. 16, the combination of the magnetic plates 14 provides a step profile of magnetic flux density of the type shown in FIG. 17B. Unless both ends of the vertically vibrating voice coil 5 pass beyond the flat portion on both sides of the flux density distribution, the area of the hatched portion in FIG. 17B remains the same and a constant driving force F will act on the coil 5. As a consequence, when a sinusoidal current flows through the coil 5, a simple harmonic driving force F is produced to minimize the possible harmonic distortion.

Figure 18A:
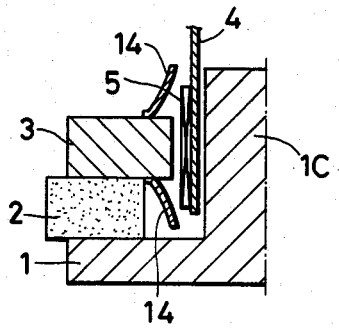
FIGS. 18A through 18D are partial cross sections showing variations of the embodiment of FIG. 11.
Figure 18B:
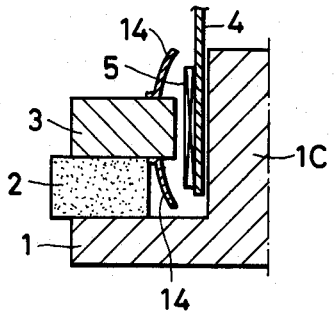
Figure 18C:
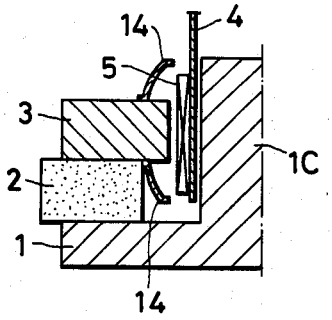
Figure 18D:
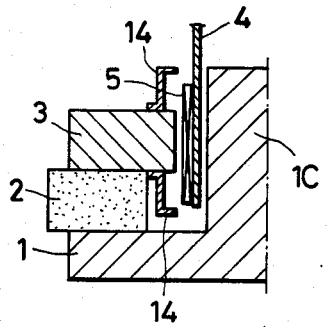

The inclination of the tapered magnetic plate 14 need not be linear, and it may be curved either outwardly as in FIG. 18A, inwardly as in FIG. 18B, or shaped as shown in FIG. 18C or FIG. 18D.

Figure 19:
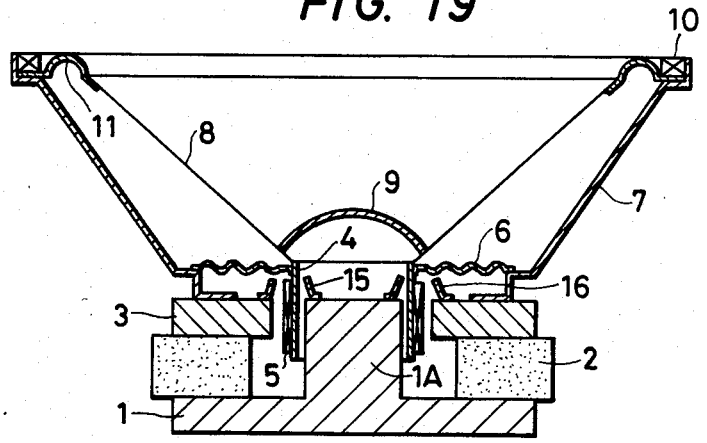
FIG. 19 is a cross section showing a further modification of the magnetic flux density setting arrangement.

A further modification of the magnetic flux density setting arrangement is depicted in cross section in FIG. 19, wherein components which are the same as those shown in FIG. 1 are identified by like reference numerals. In this embodiment, the top of the center pole 1A of the pole yoke 1 is provided with a flared magnetic plate 15 which increases in outside diameter away from the center pole. At the same time, the top of the plate 3 is provided with a tapered magnetic plate 16 that decreases in inside diameter away from the plate 3 and which is positioned in a face-to-face relation with the magnetic plate 15. The two magnetic plates 15 and 16 combine to provide a magnetic flux density pattern that maintains the value of the force factor Bl constant, at least within the limits of the oscillatory movement of the voice coil 5. According to the arrangement shown in FIG. 19, the combination of the magnetic plates 15 and 16 provides a flux density distribution profile of the type shown in FIG. 20B, and as long as the upper end of the voice coil 5 at the upper limit of its vertical movement is within the space defined by the magnetic plates 15 and 16, the area of the hatched section in FIG. 20B remains substantially the same and a constant driving force F will act on the coil 5.

Figure 21:
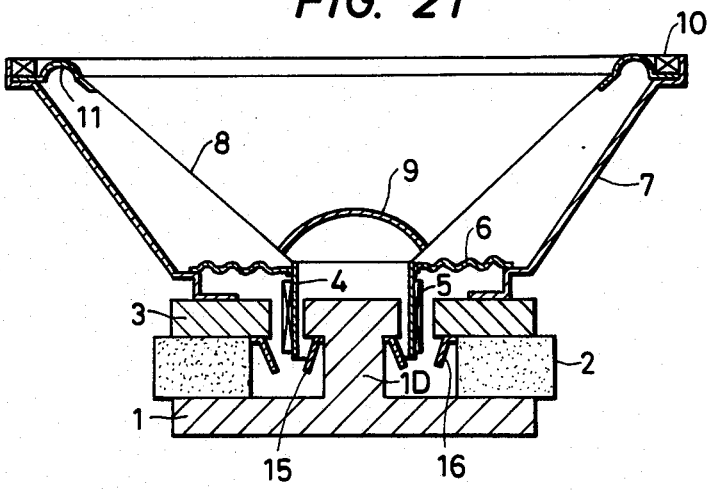
FIG. 21 is a cross section showing a modification of the embodiment of FIG. 19.

In the embodiment shown above, the magnetic plates 15 and 16 are disposed above the voice coil 5. Instead, as shown in FIG. 21, both plates may be disposed below the coil 5 with the plate 15 extending downward from a center pole 1D whose diameter is reduced below the portion that faces the plate 3. This arrangement provides advantages similar to those obtained in the embodiment of FIG. 19. The inclination of the magnetic plates 15 and 16 need not be linear, and instead, they may be curved as shown in FIGS. 18A and 18B.

Figure 20A:
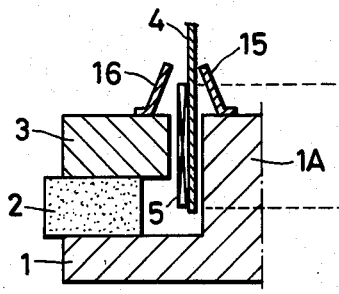
FIG. 20A is a partial cross section showing a voice coil at a certain position with respect to the magnetic gap.
Figure 20B:
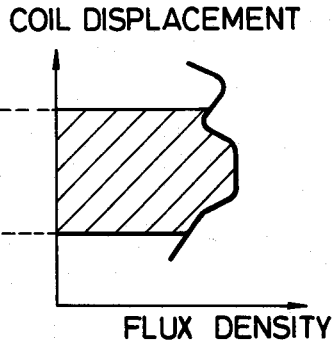
FIG. 20B shows the corresponding profile of magnetic flux density.
Figure 22:
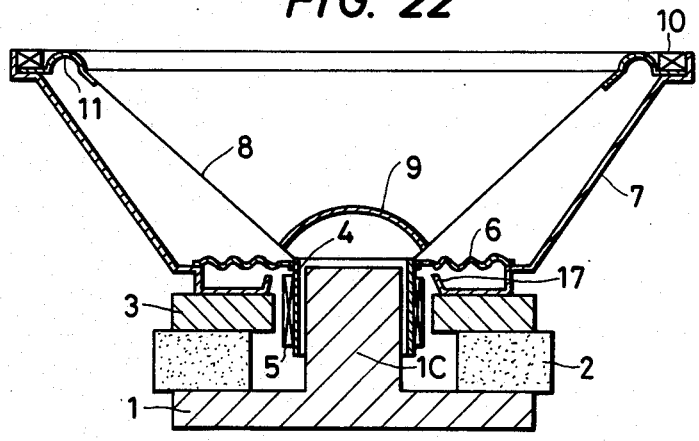
FIG. 22 is a cross section showing a still further modification of the magnetic flux density setting arrangement.

Still another modification to the magnetic flux density setting arrangement is shown in cross section in FIG. 22, wherein components which are the same as those shown in FIG. 16 are identified by like reference numerals. In this embodiment, the frame 7 is made of a magnetic material and has a riser 17 at the inner edge of the portion of the frame at which the frame is connected to the plate 3. The riser is integral with the frame 7 and has a tapered surface which decreases in inside diameter away from the top of the plate 3. This riser 17 provides a magnetic flux density pattern that maintains the value of force factor Bl constant, at least within the limits of the vibratory movement of the voice coil 5. According to this arrangement, the riser 17 contributes to the creation of a magnetic flux density profile which is substantially the same as depicted in FIG. 20B. Therefore, within the limits of the oscillatory movement of the voice coil 5, the force factor Bl remains constant irrespective of the coil displacement, and the driving force F acting on the coil 5 is a function of only the input current, with the result that a minimum distortion occurs.

The inclination of the tapered riser 17 need not be linear, and it may be curved as in the previous embodiments. If desired, the thickness of the riser 17 may vary between the base and top portions.

Figure 23:
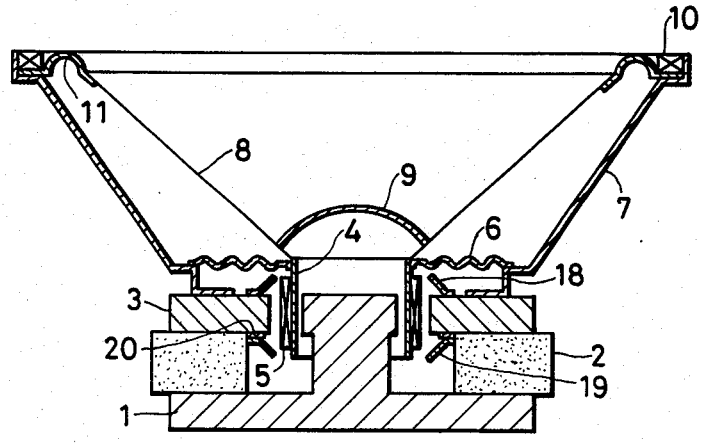
FIG. 23 is a cross section showing still another modification of the magnetic flux density setting arrangement.

A still further modification of the magnetic flux density setting arrangement of the invention is depicted in cross section in FIG. 23, wherein components which are the same as those shown in FIG. 1 are identified by like reference numerals. In this embodiment, the top surface of the plate 3 is directly provided with a tapered magnetic plate 18 that decreases in inside diameter away from the plate 3, whereas the bottom surface of the plate 3 is provided similarly with a tapered magnetic plate 19. A spacer 20 having a large magnetoresistance is inserted between the plate 3 and the magnetic plate 19. The assembly of the two magnetic plates 18 and 19 and the spacer 20 provides a magnetic flux density pattern that maintains the value of force factor Bl constant, at least within the limits of the oscillatory movement of the coil 5. If the magnetic plate 19 were directly provided on the underside of the plate 3, the magnet 2 positioned closer to the magnetic plate 19 than to the plate 18 would produce a higher magnetic flux density on the side of the plate 19 than on the side of the plate 18, thereby impairing the linearity of force factor Bl. According to the embodiment shown in FIG. 23, by properly selecting the thickness and material of the spacer 20, the magnetic flux density provided at the magnetic plate 18 can be made equal to that produced at the plate 19, ensuring an improvement in the linearity of the force factor Bl.

Figure 24A:
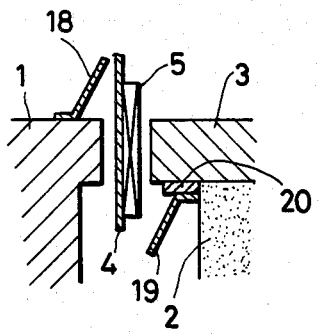
FIGS. 24A and 24B are partial cross sections showing two variations of the embodiment of FIG. 23.
Figure 24B:
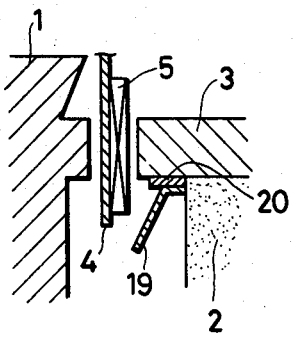

Two modifications of the embodiment shown in FIG. 23 are depicted in FIGS. 24A and 24B.

As described in the foregoing, the speaker unit according to the present invention has a cup-shaped body of magnetic material that is provided on a center pole and a metal cap that is fitted around the center pole so as to cover the magnetic material. Due to this arrangement, the driving force acting on the voice coil is held constant, irrespective of the coil displacement, and as a result, the possible distortion that could be introduced into the output sound minimized. As a further advantage, the position of the cup-shaped magnetic material is automatically determined as the metal cap is slipped over the center pole. This eliminates the need for an independent step for positioning the cup-shaped magnetic material, thereby contributing to easier assembly of the speaker unit.

As described above, depressions are formed in the side of the bobbin 4 as a result of soldering the two leads from the voice coil to the bobbin. However, the bottoms of these depressions will not contact the tapered metal cap and therefore will not prevent smooth vibration of the mobile components of the speaker unit.

If the speaker unit receives an excessive input, the voice coil may extend beyond the magnetic gap. However, as another advantage of the present invention, the taper on the metal cap enables the voice coil to return quickly into the magnetic gap.

Figure 25:
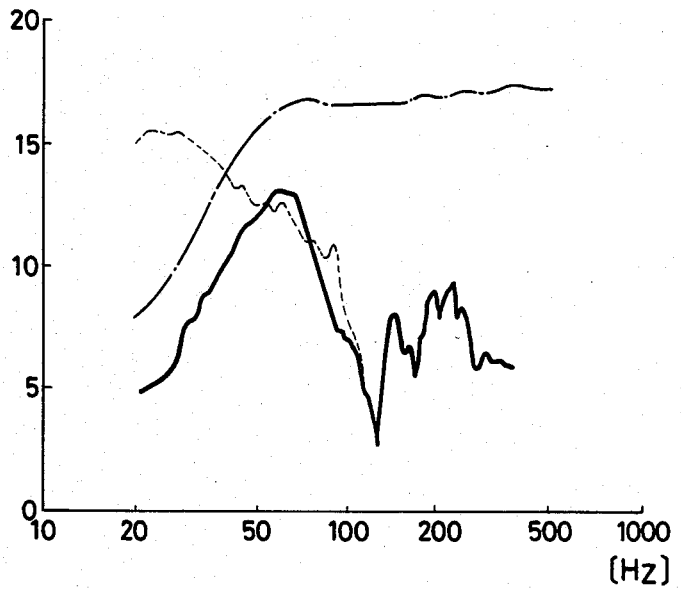
FIG. 25 is a diagram showing the distortion characteristics of a speaker of the invention (solid line) and a conventional speaker of the same general type (dashed line).

As described above, the speaker unit according to the present invention uses a voice coil wound to a length greater than the magnetic gap length and is designed to maintain a constant value of Bl, at least within the limits of the oscillatory movement of the voice coil. As a result, a driving force proportional to the input current will act on the voice coil, and this contributes to a reduction of the possible harmonic distortion of the output sound. Therefore, as is clear from FIG. 25, the present invention provides a speaker unit of better sound quality that has a smaller distortion in the range of low sound level (as depicted by a solid line) than the conventional speaker unit (as indicated by a dashed line).

I claim:

1. A speaker unit comprising: a yoke having a pole portion; a cup-shaped body of magnetic material having a bottom in contact with a pole surface of said pole portion and a flared portion that increases in diameter away from said pole surface; and a metal cap shaped and mounted on said pole portion in such a manner that it covers said cup-shaped body of magnetic material, said metal cap comprising a cylindrical portion fitted around said pole portion, a tapered portion continuous with said cylindrical portion and which decreases in diameter away from said pole surface, and a bottom continuous with said tapered portion, an outer periphery of an open end of said cup-shaped body of magnetic material being in contact with a border between said bottom and said tapered portion.

2. A speaker unit comprising: an annular plate; a yoke having a pole portion extending through the center of said plate so as to form a magnetic gap together with said plate; a voice coil disposed within said magnetic gap which is wound to a length greater than a length of said magnetic gap; and magnetic flux density setting means for maintaining constant a value of Bl, at least within limits of oscillatory movement of said voice coil, where B represents a density of magnetic flux capable of linking said voice coil and l represents an effective length of said voice coil, wherein said magnetic flux density setting means comprises at least one flared surface portion provided on said pole, said flared surface portion increasing in diameter away from a portion facing said plate, and said flared portion is located above said portion facing said plate.

3. A speaker unit comprising: an annular plate; a yoke having a pole portion extending through the center of said plate so as to form a magnetic gap together with said plate; a voice coil disposed within said magnetic gap which is wound to a length greater than a length of said magnetic gap, and magnetic flux density setting means for maintaining constant a value of Bl, at least within limits of oscillatory movement of said voice coil, where B represents a density of magnetic flux capable of linking said voice coil and l represents an effective length of said voice coil, wherein said magnetic flux density setting means comprises at least one flared surface portion provided on said pole, said flared surface portion increasing in diameter away from a portion facing said plate, and said flared portion comprises two flared surface portions, one located above and the other located below said portion facing said plate.

4. A speaker unit comprising: an annular plate; a yoke having a pole portion extending through the center of said plate so as to form a magnetic gap together with said plate; a voice coil disposed within said magnetic gap which is wound to a length greater than a length of said magnetic gap; and magnetic flux density setting means for maintaining constant a value of Bl, at least within limits of oscillatory movement of said voice coil, where B represents a density of magnetic flux capable of linking said voice coil and l represents an effective length of said voice coil, wherein said magnetic flux density setting means comprises at least one tapered magnetic plate provided on said annular plate, said magnetic plate decreasing in inside diameter away from said annular plate.

5. The speaker unit according to claim 4, wherein said magnetic plate is provided below said annular plate.

6. The speaker unit according to claim 4, wherein said magnetic plate is provided above said annular plate.

7. The speaker unit according to claim 4, wherein said magnetic plates are two in number, one being provided below said annular plate and the other being provided above said annular plate.

8. The speaker unit according to claim 4, further comprising spacer means disposed between said magnetic plate and said annular plate, said spacer means being made of a material having a large magnetoresistance.

9. A speaker unit comprising: an annular plate; a yoke having a pole portion extending through the center of said plate so as to form a magnetic gap together with said plate; a voice coil disposed within said magnetic gap which is wound to a length greater than a length of said magnetic gap; and magnetic flux density setting means for maintaining constant a value of Bl, at least within limits of oscillatory movement of said voice coil, where B represents a density of magnetic flux capable of linking said voice coil and l represents an effective length of said voice coil, wherein said magnetic flux density setting means comprises at least one tapered magnetic plate provided on said pole portion, said tapered magnetic plate increasing in outside diameter away from said magnetic gap.

10. The speaker unit according to claim 9, wherein said magnetic plate is provided below said plate.

11. The speaker unit according to claim 9, wherein said magnetic plate is provided above said magnetic gap.

12. The speaker unit according to claim 9, wherein said magnetic plates are two in number, one being provided below said magnetic gap and the other being provided above said magnetic gap.

13. A speaker unit comprising: an annular plate; a yoke having a pole portion extending through the center of said plate so as to form a magnetic gap together with said plate; a voice coil disposed within said magnetic gap which is wound to a length greater than a length of said magnetic gap; and magnetic flux density setting means for maintaining constant a value of Bl, at least within limits of oscillatory movement of said voice coil, where B represents a density of magnetic flux capable of linking said voice coil and l represents an effective length of said voice coil, wherein said magnetic flux density setting means comprises at least one tapered first magnetic plate provided on said annular plate and facing said pole portion, and at least one tapered second magnetic plate provided on said pole portion, said tapered first magnetic plate decreasing in inside diameter away from said annular plate, and said second tapered magnetic plate increasing in outside diameter away from said magnetic gap.

14. The speaker unit according to claim 13, wherein said first magnetic plate is provided below said annular plate and said second magnetic plate is provided below said magnetic gap.

15. The speaker unit according to claim 13, wherein one of said first and second magnetic plates is provided below said magnetic gap and the other is provided above said magnetic gap.

16. A speaker unit comprising: an annular plate; a yoke having a pole portion extending through the center of said plate so as to form a magnetic gap together with said plate; a voice coil disposed within said magnetic gap which is wound to a length greater than a length of said magnetic gap; and magnetic flux density setting means for maintaining constant a value of Bl, at least within limits of oscillatory movement of said voice coil, where B represents a density of magnetic flux capable of linking said voice coil and l represents an effective length of said voice coil, wherein said flux density setting means comprises a frame made of a magnetic material, said frame having a portion connected to said annular plate, and said portion having a riser at an inner edge of said portion, said riser being integral with said frame and having a tapered surface which decreases in inside diameter away from the top of said annular plate.

* * * * *